United States Patent [19]

Kunak et al.

[11] 3,968,662

[45] July 13, 1976

[54] METHOD OF FEEDING FIBERS TO A PILE FABRIC CIRCULAR KNITTING MACHINE

[75] Inventors: Anthony F. Kunak; Wayne C. Jarvis, both of Spartanburg, S.C.; Rollie B. Kidd; Bobby L. Williams, both of Morganton, N.C.

[73] Assignee: M. Lowenstein & Sons, Inc., New York, N.Y.

[22] Filed: Aug. 31, 1973

[21] Appl. No.: 393,410

[52] U.S. Cl. ..... 66/9 B; 19/104; 19/105; 19/107

[51] Int. Cl.[2] ..... D04B 9/14; D01G 15/24

[58] Field of Search ..... 66/9 B; 19/104, 105, 19/113, 99, 107

[56] References Cited

UNITED STATES PATENTS

| | | | |
|---|---|---|---|
| 1,462 | 12/1839 | Freeman | 19/105 UX |
| 2,017,073 | 10/1935 | Moore | 66/9 B UX |
| 2,128,130 | 8/1938 | Farrar | 19/105 |
| 2,255,078 | 9/1941 | Moore | 66/9 B |
| 2,879,549 | 3/1959 | Miller et al. | 19/104 |
| 2,953,912 | 9/1960 | Hill | 66/9 B |
| 3,081,499 | 3/1963 | Goldman | 19/99 |
| 3,169,278 | 2/1965 | Aoki | 19/105 |
| 3,604,062 | 9/1971 | Hollingsworth | 19/113 |

FOREIGN PATENTS OR APPLICATIONS

| | | | |
|---|---|---|---|
| 773,211 | 4/1957 | United Kingdom | 19/99 |
| 7,733 | 1838 | United Kingdom | 19/105 |
| 708,822 | 5/1954 | United Kingdom | 19/105 |

*Primary Examiner*—Robert R. Mackey
*Attorney, Agent, or Firm*—Wellington M. Manning, Jr.

[57] ABSTRACT

A card head for supplying pile fibers to a knitting machine is disclosed herein along with a method for using same. Precarded, pre cut fibers in sliver form are presented to a fluted roll in proximity to a highly polished nose guide. Sliver is fed therethrough to a clothed main cylinder rotating at a higher speed than the fluted roll to separate cut fibers from the sliver. Flats or the like are secured around a portion of the main cylinder and cooperate with the main cylinder in proper alignment of fibers floating thereon. A doffer roll is positioned adjacent the end of the flats, barely out of contact with the card clothing and rotating at a higher speed than the main cylinder. Teeth on the doffer thus remove the fibers from the main cylinder and properly present same to knitting needles passing thereacross. The card head is provided with cover plates to control air flow therethrough which assists in floating of the fibers and proper operation thereof. Likewise, a combination air-guide arrangement is employed to properly position the fibers around the shank of the needles preparatory to knitting.

4 Claims, 7 Drawing Figures

METHOD OF FEEDING FIBERS TO A PILE FABRIC CIRCULAR KNITTING MACHINE

BACKGROUND OF THE INVENTION

The introduction of discrete fibers to a base knitting yarn during a knitting operation is an old technique for the production of knitted fabrics having a pile surface or effect. Generally, the pile knitting machines are equipped with a plurality of means around the perimeter thereof that supply discrete fibers to a position where the fibers are removed by knitting needles passing thereby. The fibers are then associated with a base yarn and knitted into the fabric with the ends of the fibers extending outwardly to provide the pile surface. Normally, the fiber feed means include apparatus which receives sliver or the like, cards and/or aligns the fibers and presents the worked fibers to the knitting needles. Development effort has been expended in the past to improve these feeding or card heads. For example, improvements have been made so as to better work the fibers; to increase the feeding capacity of the card heads; to vary the density of pile fibers knitted into the fabric; to mix feeds from adjacent systems; to handle various lengths of fibers, and the like.

Such attempts as set forth above have included various arrangements for presenting the fibers to a rotating working cylinder of the card head; proper handling of the fiber on the working cylinder and primarily, devices and techniques for removal of the fibers from the working cylinder and presenting same to the knitting needles as they pass thereby. The present invention represents yet another improvement for a knitting system for the production of pile fabrics. Present emphasis is directed to the card heads positioned around the knitting machine to improve output capacity, handling of shorter fibers and the like. The present invention affords advantages heretofore unavailable to the knitting industry and is a definite advance in the art.

As listed below, there is a voluminous amount of art in this particular area. The present invention is, however, neither suggested or taught by the patented prior art. Exemplary of this prior art are U.S. Pat. Nos. 1,114,414 to Tauber; 2,280,535 to Moore; 2,953,912 to Hill; 2,971,357 to Hill; 2,993,351 to Wheelock; 3,010,297 to Hill; 3,019,623 to Howes; 3,045,459 to Hill; 3,095,614 to Moore; 3,122,904 to Brandt; 3,153,335 to Hill; 3,188,834 to Radtke; 3,248,902 to Radtke; 3,295,337 to Beucus et al; 3,299,672 to Schmidt; 3,412,823 to Beucus et al; 3,447,343 to Frishman et al; 3,495,422 to Miller; 3,501,812 to Schmidt; 3,516,265 to Collez; 3,604,062 to Hollingsworth; 3,651,664 to Collez et al; and 3,685,315 to Delberghe.

SUMMARY OF THE INVENTION

It is an object of the present invention to provide a novel system for the knitting of pile fabrics.

Another object of the present invention is to provide novel apparatus for the feeding of pile fibers to a knitting machine.

Still another object of the present invention is to provide a novel method for the feeding of pile fibers to a knitting machine.

Still further, another object of the present invention is to provide novel apparatus for the manufacture of knitted high pile fabric.

Yet another object of the present invention is to provide an improved card head for a pile fabric knitting machine.

Generally speaking, the apparatus of the present invention comprises a feed means for supplying a sliver of precarded, pre cut fibers to a rotatable cylinder having card clothing thereon, means cooperating with said cylinder for aligning and transporting said fibers without substantial embedding of said fibers and rotary means located just out of contact with said cylinder, said rotary means being rotatable at a speed higher than said cylinder and removing fibers therefrom, said rotary means further being located adjacent a knitting machine and presenting pile fibers to said machine.

More specifically, the pile fabric knitting machines, such as a Wildman Jacquard double knit machine, for example, knit a tubular fabric entrapping the pile fibers therein. Generally speaking, a plurality of card head feed units are positioned around the circumference of the knitting machine and supply staple pile fibers to the knitting machine from the various points of feed. A base fabric is then knitted in a conventional manner while simultaneously entrapping the pile fibers among the loops thereof. The pile fibers are held at one end thereof, with the remaining length extending outwardly from the fabric to provide a particular appearance or characteristic.

A preferred card head unit according to the present invention includes a main cylinder having card clothing thereon and being rotatable in a first direction. Feed means are positioned at one side of said main cylinder for supplying carded, pre cut sliver thereto, the feed means including a single rotatable combination fluted-toothed roll that cooperates with a highly polished nose plate guide adjacent thereto to supply fibers in sliver form to the rotatable main cylinder. The main cylinder rotates at a higher speed than the fluted roll and separates individual fibers from the sliver without substantially embedding the fibers in the clothing on the cylinder. A guide means is positioned above a portion of the periphery of the main cylinder at a predetermined distance therefrom and cooperates with the main cylinder clothing so as to work and direct the fibers preparatory to presenting same to the knitting needles. The inner surface of the guide may be smooth, knurled or may have a series of teeth thereon as defined in the U.S. Pat. No. 3,604,062 to Hollingsworth. On the exit side of the main cylinder and operatively associated therewith is a rotatable doffer roll having bristle type members received around the circumference thereof. The doffer is rotatable in a direction opposite to the direction of the main cylinder and the bristle members of the doffer are just out of contact with the clothing of the main cylinder. The doffer elements engage the individual fibers floating on the clothing of the main cylinder and remove the fibers therefrom. Moreover, the doffer rotates at a peripheral speed greater than the main cylinder so as to establish some drawing of the fibers for the successful removal thereof.

The bank of needles provided on the knitting machine pass across the doffer in a direction transverse to the direction of rotation of the doffer and strip the fibers therefrom. Means associated with the needles and the doffer prevent any interference from the doffer after the fibers have been received by the needles. Further, a guide progressively forces fibers downwardly along the shank of the needles, after which a base yarn is inserted into the eye of the needle above the fibers and the base fabric is knitted, entrapping the fibers in a conventional manner.

The card head unit according to the teachings of the present invention is further preferably constructed so as to control air currents therethrough. Improved fiber feeding to the knitting needles is thus fostered. In this regrd, the card head is enclosed around a portion thereof to direct air currents in the direction of movement of the fibers around the main cylinder. The doffer is also partially enclosed to direct air currents at the fiber transfer where the air is then exhausted from the vicinity of the knitting machine. An exhaust duct extends downwardly into the middle of the knitting machine just above the fabric take up roll. Air passing into the duct removes excess fibers, unbound fibers, lint and the like from the interior of the knitting machine. Furthermore, an air conduit is provided around the periphery of the knitting machine so as to remove lint and excess fibers from the outside of the knitting machine. The feed unit of the card head is also provided with air duct to remove waste from the main cylinder and the fluted feed roll. Accumulation of any fiber waste is thus substantially precluded whereby nebs and the like are not introduced into the system.

Card head units around the knitting machine are preferably associated with a universal drive system whereby all of the card heads may be simultaneously controlled. Fiber feeding speeds may thus be uniformly controlled to improve fabric uniformity and quality.

The method of the present invention generally involves the steps of supplying fibers to a card head for a high pile knitting machine, substantially floating the fibers through the card head while separating and aligning the fibers, removing the fibers from the card head while precluding contact with the card head, presenting individual fibers to knitting needles passing thereby in sequential fashion, said fibers being substantially centered around said needles; forcing said fibers downwardly along said needles; inserting a base yarn in the eyes of said needles above said fibers and knitting said yarn into a base fabric while simultaneously entrapping said fibers in said fabric at one end thereof.

More specifically, discrete carded fibers are fed in sliver form to the card head unit where the fibers are separated from the sliver by a main cylinder having card clothing therearound and rotating at a higher rate of speed than fibers being fed thereto. Care is taken to avoid fibers being forced down into the card clothing. Instead, the fibers float atop the card clothing as they are transferred by the rotating cylinder. Such floating action is possible due to the absence of a lickerin roll or the like, by using controlled air currents through the card head; spacing between the component parts and the like. The fibers remain in a substantially floating condition during the entire time they are on the cylinder and when presented to the doffer are properly removed thereby, leaving very little if any waste on the cylinder. Knitting needles moving sequentially across the surface of the rotating doffer engage the fibers at or near the center of the fiber length for removal. Those fibers otherwise engaged remain on the doffer. The needles move across the doffer in a direction transverse to the direction of rotation thereof and intermesh with the bristles or the like, each needle removing a predetermined amount of fiber therefrom.

As the individual needles move away from the doffer with fiber positioned therearound in a substantially uniform fashion, i.e., the needle contacts the center of the fibers a stationary guide is encountered, a lower inclined surface of which progressively forces the fibers downwardly along the needle shanks so as to enable a base yarn to be fed to the needles above the fibers. The base yarn is then knitted into a base fabric with the fibers around the needles being simultaneously entrapped therein at one end thereof. The remaining length of the fibers then extends above the surface of the base fabric providing the high pile surface effect.

DESCRIPTION OF THE PREFERRED EMBODIMENTS

Figure 1:
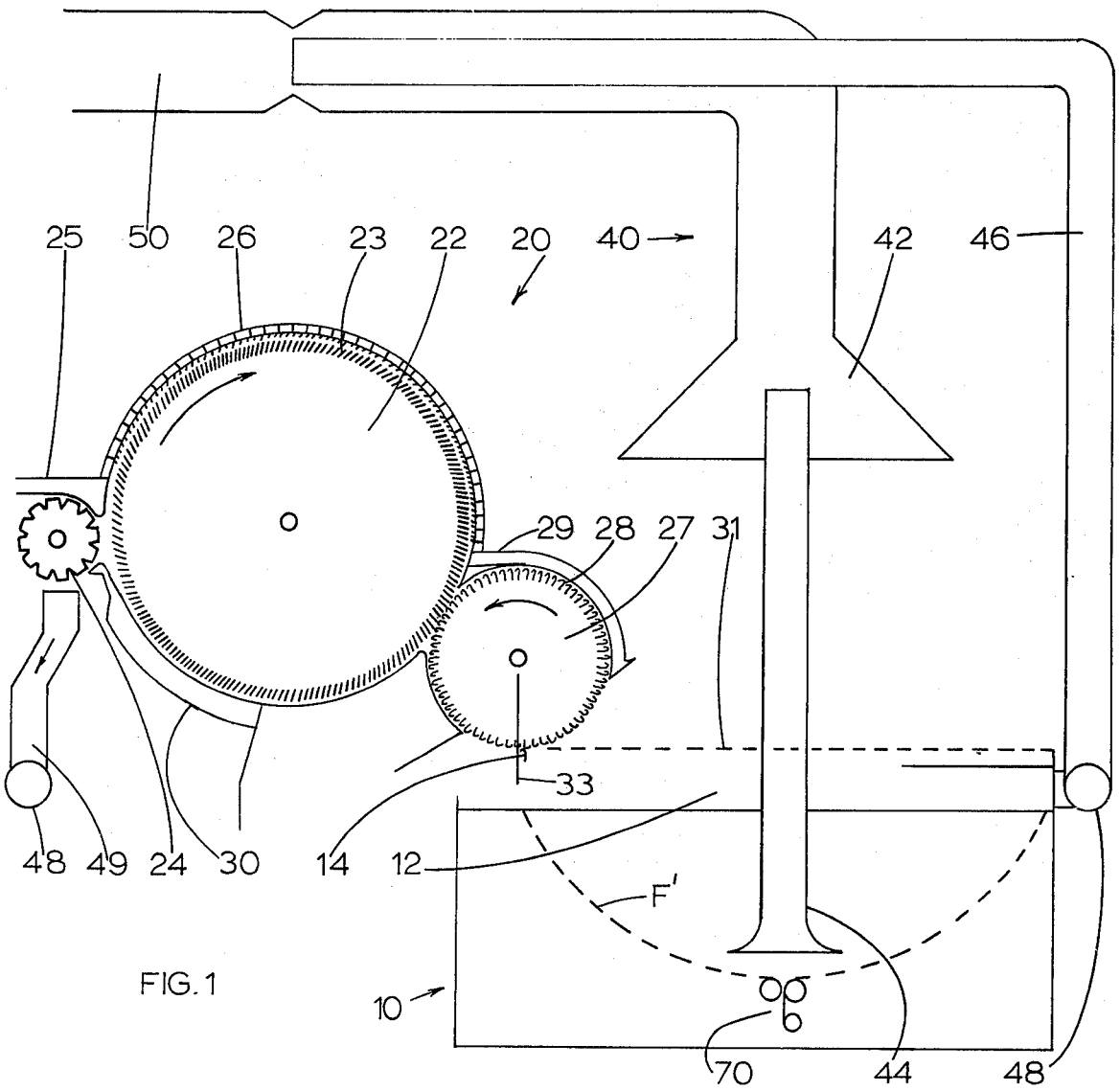
FIG. 1 is a side elevational schematic view of apparatus embodying the present invention.

A preferred embodiment of the present invention will now be described in detail with reference to the Figures. FIG. 1 schematically illustrates, in general, apparatus according to the present invention. A knitting machine generally indicated as 10 is provided for knitting the pile fabric, utilizing the apparatus and method of the present invention. A suitable knitting machine might be of the Wildman Jacquard type and is well known to those skilled in the art. A detailed description of the knitting machine is thus felt not necessary for a complete understanding of the present invention. Knitting machine 10 does, however, have a cylinder 12 extending therearound, and having a plurality of knitting needles 14 positioned thereon. A tubular knit fabric F′ is produced and taken up on a suitable means 70 therefor.

At several points around the periphery of the knitting machine, only one of which is shown in FIG. 1, card heads generally indicated as 20 are positioned. The various card heads 20 are utilized to supply discrete staple fibers to the knitting needles 14 after which the pile fibers so supplied are entrapped in the base fabric as the fabric is knitted on knitting machine 10. Depending upon the desires of the individual and as described hereinafter, the plurality of card heads 20 are preferably controlled by a single drive means whereby the operational speed of same may be coordinated and controlled by a single adjustment (See FIG. 7). In addition to the knitting machine 10 and the card heads 20, an air handling system generally indicated as 40 is provided so as to properly handle air flow in and around the card heads 20 and the knitting machine 10 to further improve the operational efficiency of the apparatus and the process.

The apparatus of the present invention is further quite versatile. For example, fiber density on the ultimate fabric may be substantially varied by varying the density of sliver being fed to the card heads and/or varying the speed of the feed roll 24. Moreover, the apparatus can handle various lengths of fiber. In fact, fibers ranging in length from ¾ inch to 4½ inches may be employed without any adjustment to the card heads. Historically, great difficulty has been experienced in handling ¾ inch fibers and also in achieving a proper high fiber density on the fabric without the presence of slubs. For example, a fiber density of at least 15 ounces per square yard may be achieved with higher densities of up to approximately 38 ounces per square yard of fabric likewise being possible.

The card heads 20 according to the teachings of the present invention comprise a main cylinder 22 having card clothing 23 received around the periphery thereof. Main cylinder 22 is journaled for rotation in a support frame (not shown) and serves a primary purpose of separating, transferring and aligning fibers in contact therewith prior to removal thereof at the doffer and feeding same to the knitting machine. A fluted roll with teeth 24 and a highly polished nose guard 25 cooperate to provide a feed means for supplying fiber to the main cylinder 22 adjacent one side thereof. Abutting nose guard 25 and extending around a portion of the circumference of main cylinder 22 is a peripheral guide or flat 26 which will be explained in greater detail hereinafter. It should be pointed out, however, that nose guard 25 is contiguous with guide 26. On the opposite side of main cylinder 22, a doffer 27 is received for rotation in a direction opposite to main cylinder 22. Doffer 27 has a plurality of fiber engaging elements such as bristles 28 or the like received therearound to engage fibers on main cylinder 22, remove same and present the fibers to knitting needles 14 passing thereacross. Doffer 27 and bristles 28 are located adjacent main cylinder 22 and do not contact the card clothing 23 of main cylinder 22. Instead, individual fibers being handled by the main cylinder 22 are engaged by bristles 28 during rotation of doffer 27. Due to the relative rotational speeds of doffer 27 and main cylinder 22, bristles 28 impale the fibers F and remove same from main cylinder 22.

Card head 20 further has an air guide 29 adjacent doffer 27, the purpose of which will be described in greater detail hereinafter. Furthermore, a bottom guide 30 is also provided, the purpose of which will be described in greater detail hereinafter.

Fibers picked up by bristles 28 of doffer 27 are presented to the knitting needles 14 that pass in a direction substantially transverse to the direction of rotation of doffer 27 and engage the fibers being held by bristles 28. Those fibers that are engaged at their approximate midpoint by needles 14 are removed from doffer 27 while others overcome the frictional resistance of needles 14 and remain on doffer 27 for another pass. Hence fibers are continually presented to needles 14 which pass in succession through the bristles 28 of doffer 27 and remove a particular amount therefrom. A fiber guard 31 is located immediately adjacent doffer 27, and is so positioned that once the fibers F are positioned around knitting needles 14, guard 31 is positioned between the fibers and bristles 28 whereby the fibers are protected against any later interference. Furthermore, as needles 14 continuously move around cylinder 12, air is directed thereagainst from a nozzle 32 which forces the ends of the fibers F inwardly towards the center of the knitting machine so as to properly position the fibers for subsequent entrappment in the knitted fabric. Immediately after movement away from doffer 27, fibers F on needles 14 are engaged by a vertical angularly presented guide plate 33 which may be best seen in FIG. 5. The angular presentation of guide plate 33 progressively forces fibers F downwardly along the shanks 14' of needles 14, after which a base yarn Y (shown in FIG. 5) is placed in the hooks 14'' of the knitting needles 14 and is subsequently knitted into the base fabric while simultaneously entrapping fibers F therein so as to produce a knitted pile fabric.

Figure 6:
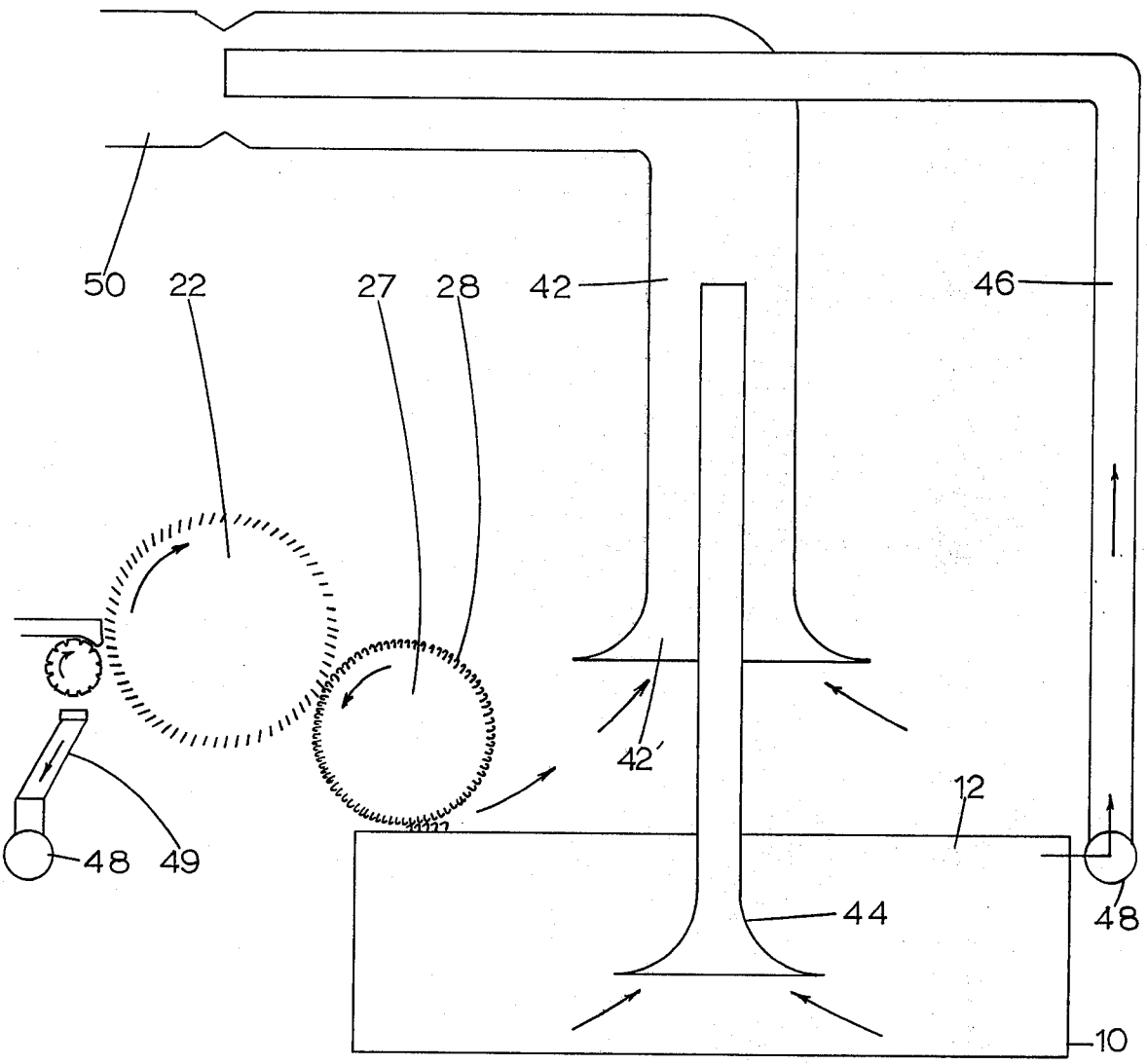
FIG. 6 is a schematic illustration of the air handling system according to the teachings of the present invention.

The air handling system 40 as shown in FIGS. 1 and 6 comprises a first hood 42 that terminates above knitting machine 10 with the card heads positioned therearound in proximity thereto. A second hood 44 is concentric with hood 42 and extends downwardly therefrom inside knitting machine 10 so as to remove lint, excess fibers and the like from the inside portion of the knitting machine and from the fabric being knitted and taken up thereat. A manifold 46 also communicates with hood 42 and terminates at an exhaust conduit 48 that surrounds the upper portion of knitting machine 10. A second exhaust conduit 49 is positioned beneath each card head 20 adjacent the fiber feed system and communicates with hood 42 in conduit 48. Air suction means schematically illustrated as 50 are operatively associated with the main hood 42 and hence with all of the exhaust systems so as to create air suction therethrough. Air suction through the system creates air currents around the affected areas of the knitting machine and remove lint, fly and the like from the areas which the individual elements serve. The particular operation of the air handling system of the present invention will be described in greater detail hereinafter.

Figure 2:
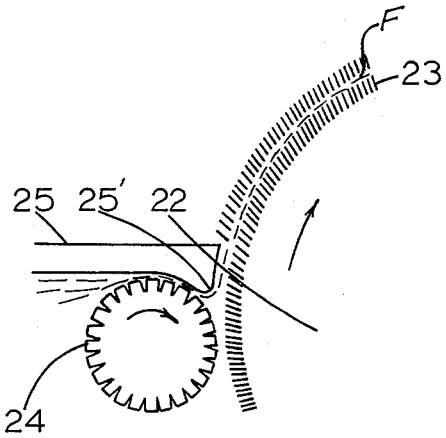
FIG. 2 is a cut away view showing fiber feed to a card head unit for a pile knitting machine according to the teachings of the present invention.
Figure 3:
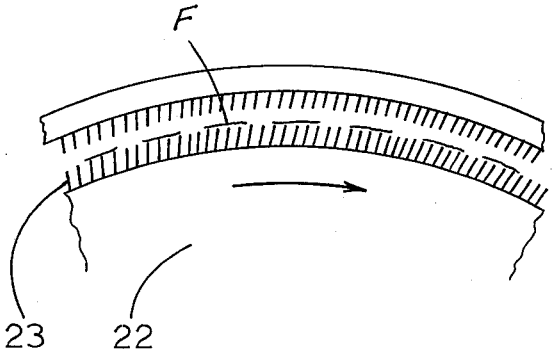
FIG. 3 is a cut away view of a portion of a card head attachment according to the present invention, illustrating a particular feature thereof.

An important feature of the present invention is proper handling of the fibers in a particular fashion. FIGS. 2 and 3 illustrate working of the fibers and apparatus therefor as follows. The main cylinder 22 having appropriate card clothing 23 received therearound rotates in a direction indicated by the arrow. Fiber F is fed in the form of a sliver, roving or the like (not shown) to the card head from a source such as sliver can or the like. Fluted, toothed roll 24 compresses fibers F against nose guard 25 and pulls the fibers therethrough. In so doing, there is some drawing of the fibers during feeding. Guide 25 has a nose portion 25' around which fibers F pass. Nose portion 25' of guide 25 is preferably highly polished metal to insure proper passage of fibers therearound, and is positioned a predetermined distance away from the card clothing 23 of main cylinder 22. Fibers exit from the feed means into the path of rotating main cylinder 22, where they are engaged by card clothing 23 and separated from the sliver. No appreciable pressure is exerted against the fibers at main cylinder 22 whereby the fibers are not appreciably embedded in the card clothing 23. Instead, fibers F float on top of the card clothing during rotation of main cylinder 22. Obviously, a certain amount of fiber embedding must occur. There is, however, in the sense of the present invention, no substantial embedding of fibers in card clothing 23 which provides a cleaner system, reduces nebs, and enables better fiber alignment. Note, for example, in FIGS. 2 and 3 that separated fibers F are shown floating on card clothing 23 of main cylinder 22, and not embedded therein. As fibers F pass around main cylinder 22, curved guide 26 takes over where guide 25 leaves off. Guide 26 as mentioned above may have a smooth or other surface. An irregular surface on the underside of guide 26 is illustrated in the Figures. The irregular surface cooperates with card clothing 23 so as to properly work fibers F during passage thereby, prior to their being fed to the knitting machine. Preferably, the irregular surface 26′ is represented by a plurality of steel teeth secured to guide 26 and angularly disposed in a direction opposite the direction of rotation of the main cylinder. This particular configuration is of the general type described in U.S. Pat. No. 3,604,062 to Hollingsworth.

Figure 4:
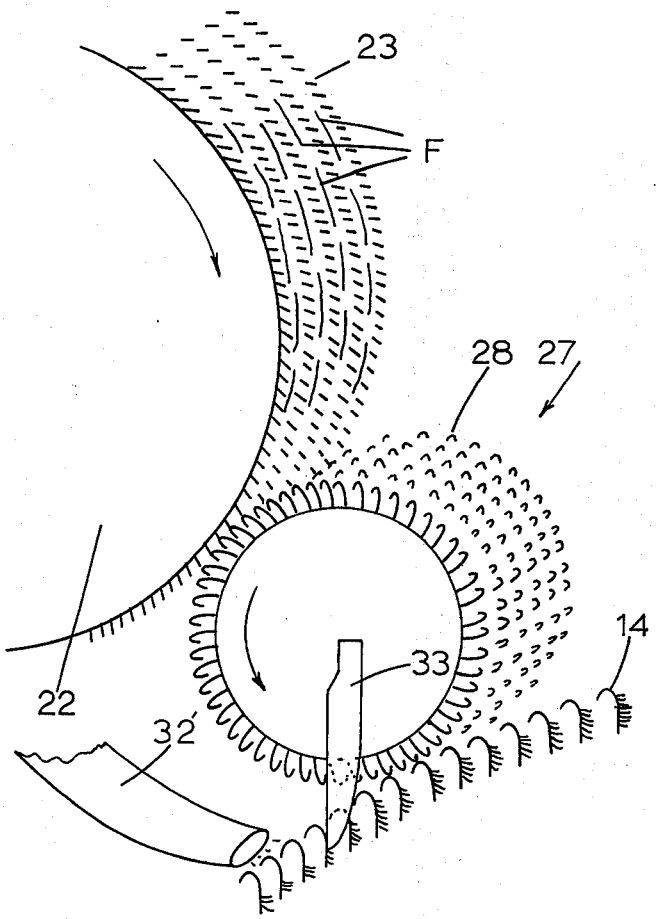
FIG. 4 is a partial view in perspective illustrating a portion of the apparatus of the present invention and fiber transfer therealong.

FIG. 4 is provided to better illustrate fiber transfer through the card head 20 to the needles 14 of knitting machine 10. The fibers F during transfer, as mentioned above, are floating on the clothing 23 of the main cylinder 22 rotating at a particular speed in a clockwise direction, for example. The doffer 27 having bristles or the like 28 thereon rotates in an opposite direction, counterclockwise, for example, such that bristles 28 and clothing 23 pass each other at the point of fiber transfer. Bristles 28 are barely out of contact with the clothing 23 of main cylinder 22 and doffer 27 rotates at a speed higher than main cylinder 22 so as to facilitate fiber transfer. In other words, as bristles 28 approach a point of convergence with main cylinder 22, bristles 28 engage fibers F that are floating on clothing 23 and lift same therefrom, the fibers being impaled by bristles 28. As doffer 27 rotates, needles 14 of knitting machine 10 successively pass by the bristles 28, engaging the fibers F and removing such fibers as are contacted at their approximate mid points thereby. A protective guard 31 secured to a framework (not shown) is positioned adjacent the path of needles 14 and precludes interference with fibers F by bristles 28 once the fibers are received on needles 14 and leave doffer 27. An air nozzle of comb 32′ is further provided adjacent the fiber receiving area so as to provide an air stream against the fibers and cause the fiber ends to extend inwardly with respect to knitting machine 10.

Figure 5:
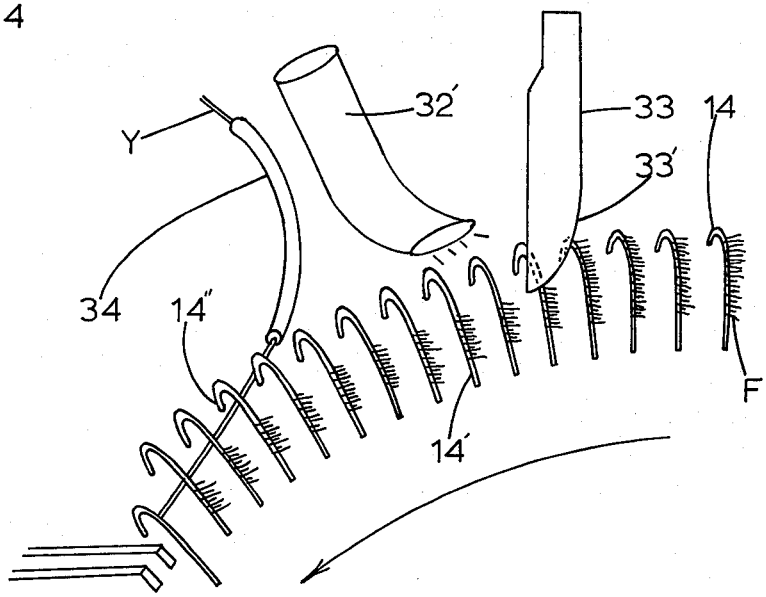
FIG. 5 is an enlarged view of a portion of a pile knitting machine showing fiber handling by the knitting needles according to the present invention.

To insure proper entrappment of fibers F in the base knitted yarn, it is desirable to present the fibers beneath a base yarn Y that is to be knitted by needles 14. This is accomplished by securing a guide 33 as is best seen in FIGS. 4 and 5 in the path of needles 14 as they leave doffer 27. Guide 33 has an inclined lower surface 33′, angling downwardly away from doffer 27 along the needle path and forces fibers F progressively downwardly along the shanks 14′ of needles 14. As the fibers F are being forced downwardly along needles 14, a base yarn Y is then passed through a thread guide 34 and inserted in the hooks, 14″ of needles 14 as is shown in FIG. 5. Yarn Y is fed by a conventional means and the feeding of same is thus not elaborated on herein.

Making reference to FIG. 6, the air system of the present invention will be described. Proper air flow through the card heads 20 positioned around knitting machine 10 further improves the overall operation of the apparatus and method of the present invention. In this regard, note that a first hood 42 is positioned adjacent doffer 27, above knitting machine 10. A suction means generally indicated as 50 produces air currents upwardly through hood 42 from the area surrounding opening 42′. Main cylinder 22 is provided on its top as shown in FIGS. 1 and 2 with nose guide 25, arcuate guide 26 and air guide 29 that partially surrounds doffer 27. Air flow is thus directed from the fiber feed system around main cylinder 22 over the top half thereof, under doffer 27 and up, into hood 42. These air currents, of course, remove loose fly and lint from the system and further, insofar as card heads 20 are concerned, assist in floating fibers F through the card heads per se. A second hood 44 extends concentrically from within first hood 42 down into knitting machine 10 and removes loose fibers, fly, lint, trash and the like from the inside of knitting machine 10. Likewise, a manifold 46 extends from within hood 42 and downwardly to an exhaust conduit 48 that is positioned around the exterior of knitting machine 10 adjacent needle cylinder 12 to remove unwanted materials from that area. A further exhaust conduit 49 is operatively associated with the feed system of each card head 20. As shown in FIGS. 1 and 6, conduit 49 is positioned just below fluted roll 24 of the fiber feed system, and adjacent perforated screen 30. Header 49 thus removes waste fiber from the feed system as well as waste fiber that was not transferred by doffer 27 and continues to pass around main cylinder 22. Nebs are thus held at a minimum.

Figure 7:
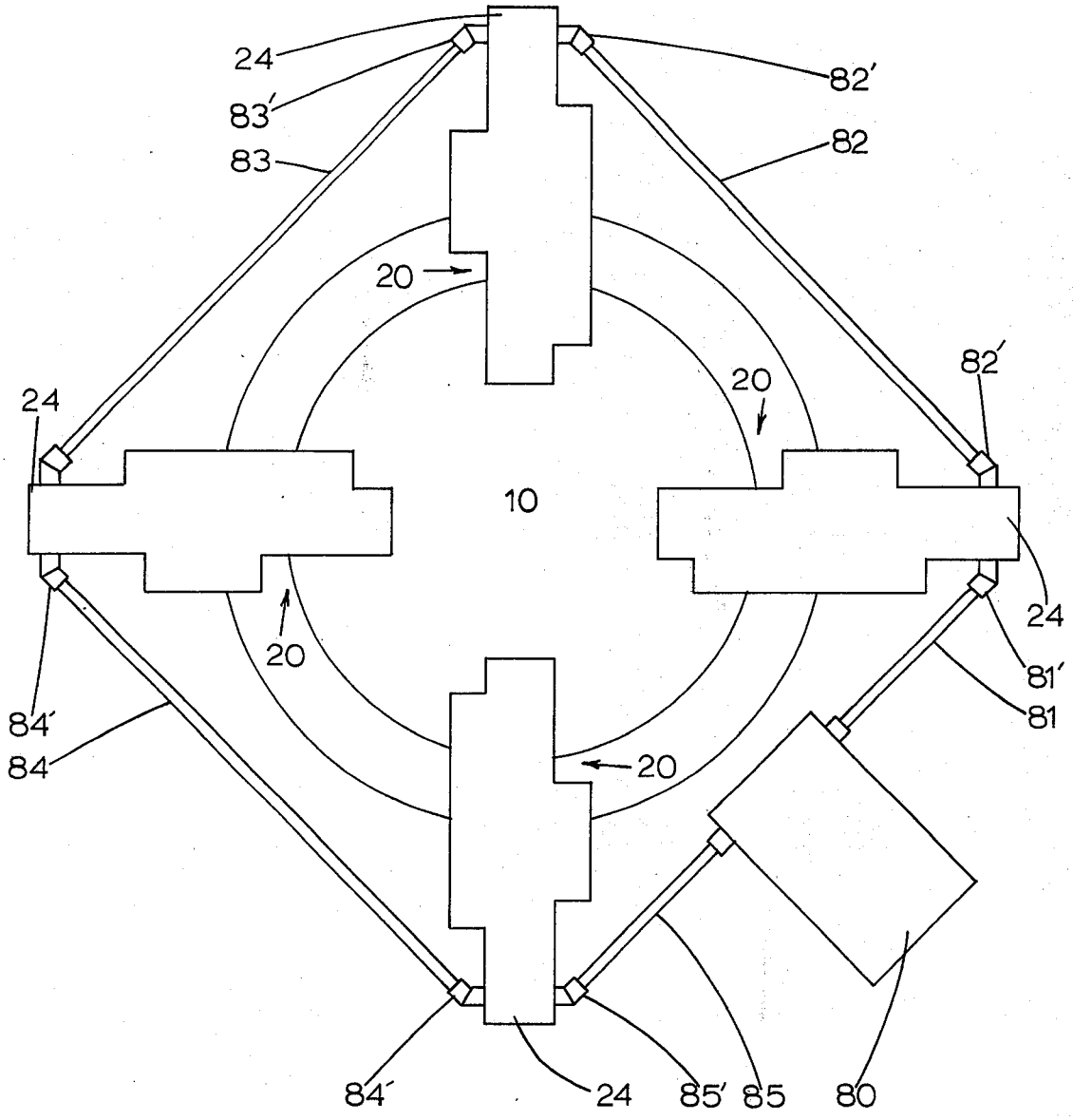
FIG. 7 is a top plan view of a knitting machine with card heads disposed therearound according to one embodiment of the present invention.

FIG. 7 illustrates a preferred feed drive system for the card heads of the present invention. The feed means, illustrated by the fluted rolls 24 of each card head 20 are provided with drive rods 81, 82, 83, 84 and 85 for the four card heads. These drive rods, through universal couplings 81′, 82′, 83′, 84′ and 85′, respectively, connect all of the feed systems through a single variable speed drive unit 80. As such, the feed rate of all of the card heads 20 may be controlled through the single drive unit 80 and the feed rate of all the units may be simultaneously changed by a single adjustment of drive unit 80. Corresponding feed rate adjustments are then conveyed through the respective drive rods from feed unit to feed unit around the knitting machine. Utilizing this preferred arrangement, it is not necessary, once the system is initially adjusted, to make additional modifications to the individual feed heads 20. Better uniformity of fiber feed is thus realized.

Having described the apparatus of the present invention, the method of operation will now be described with reference to FIG. 1.

A rope, sliver or the like of fiber F is engaged by a fluted feed roll 24 at each of the feed units 20 positioned around knitting machine 10. Rotation of roll 24 draws fiber F thereby and presents a continuous fiber flow around nose 25′ of guide 25 to a rotating main cylinder 22. Fibers F are engaged thereat by clothing 23 of main cylinder 22, separated from the sliver and follow the rotary movement of the cylinder without becoming substantially embedded in the card clothing. As the fibers pass around the main cylinder, they are worked by main cylinder 22 in cooperation with arcuate guide 26 to properly align same. All the while, the fibers are floating on main cylinder 22 without becoming substantially embedded therein. As the fibers move around cylinder 22, they approach doffer 27 havving a plurality of bristles 28 received therearound and extending outwardly therefrom. Doffer 27 is rotating in the opposite direction of main cylinder 22 at a higher surface speed than main cylinder 22. As such, bristles 28, without engaging card clothing 23, lift fibers F from main cylinder 22 and present them to successive knitting needles 14 that pass by bristles 28 of doffer 27. Needles 14 pass in a direction transverse to the direction of rotation of doffer 27 and as such strip fibers F therefrom. During the operation, air currents are channeled in the direction of fiber feed through the unit and assist in removing lint, fly and the like from the card head while further assisting in floating fibers F between the main cylinder 22 and guide 26.

Once the fibers F are stripped from doffer 27 by needles 14, an adjacent guard 31 prevents any further interaction between the fibers F and the bristles 28 of doffer 27. Immediately thereafter, needles 14 with fiber bunches thereon receive an air blast which positions fiber ends internally of needles 14. Needles 14 then engage an angled guide 33 which progressively forces fibers F downwardly along the shanks 14' of needles 14. A base yarn Y is then inserted into the hooks 14'' of needles 14 and knitted into a base fabric (not shown). Once the fibers F are received around the needles 14 with a base yarn positioned thereover, the knitting machine knits the base yarn into a base fabric while simultaneously entrapping individual fibers F in bunches so as to produce a pile fabric. In utilizing the method and apparatus of the present invention, a pile fabric may be realized having a greater density, better cover and the capability of having shorter fiber secured therein.

Having described the present invention in detail, it is obvious that one skilled in the art will be able to make variations and modifications thereto without departing from the scope of the invention. Accordingly, the scope of the present invention should be determined only by the claims appended hereto.

What is claimed is:

1. A method of handling pile fibers preparatory to feeding the fibers to the needles of a pile fabric circular knitting machine comprising the steps of:

a. feeding discrete fibers between a fluted roll and a polished guide directly to a rotating clothed cylinder;

b. separating fibers by cooperation between clothing on said cylinder and said polished guide while avoiding any substantial embedding of fibers in said cylinder clothing;

c. separating and aligning said fibers on said rotating clothed cylinder during transport of same while precluding any substantial embedding thereof, said cylinder cooperating with a guide positioned adjacent thereto;

d. contacting only said fibers being carried on said clothed cylinder with fiber engaging elements rotating in a direction opposite the direction of rotation of said clothed cylinder and removing said fibers from said cylinder for transfer to the needles of the knitting machine, said fibers having passed through a closed system in transit from the fluted roll and polished guide through the means for removing the fibers from the rotating clothed cylinder; and e. generating an air current through said closed system at least in part externally of the closed system, whereby said fibers float atop said cylinder clothing without any substantial embedding thereof.

2. A method of handling pile fibers as defined in claim 1 wherein said polished guide is a contoured guide with a polished nose.

3. A method of handling pile fibers as defined in claim 1 wherein said guide cooperating with said rotating cylinder has teeth secured to the underside thereof, said teeth being inclined in a direction opposite the direction of rotation of said cylinder.

4. A method of handling pile fibers as defined in claim 1 wherein said fiber engaging elements are received on a doffer, said doffer rotating in a direction opposite the direction of rotation of said cylinder and at a higher rotational speed than said cylinder.

* * * * *